US008093880B2

(12) United States Patent
Boas et al.

(10) Patent No.: US 8,093,880 B2
(45) Date of Patent: Jan. 10, 2012

(54) PROGRAMMABLE VOLTAGE REFERENCE WITH A VOLTAGE REFERENCE CIRCUIT HAVING A SELF-CASCODE METAL-OXIDE SEMICONDUCTOR FIELD-EFFECT TRANSISTOR STRUCTURE

(75) Inventors: Andre Luis Vilas Boas, Campinas (BR); Alfredo Olmos, Austin, TX (US); Stefano Pietri, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 466 days.

(21) Appl. No.: 12/277,695

(22) Filed: Nov. 25, 2008

(65) Prior Publication Data

US 2010/0127687 A1 May 27, 2010

(51) Int. Cl.
*G05F 3/08* (2006.01)

(52) U.S. Cl. ..... 323/312

(58) Field of Classification Search ..... 323/311–315; 327/511, 513, 539, 572; 374/178
See application file for complete search history.

(56) References Cited

U.S. PATENT DOCUMENTS 6,278,333 B1 * 8/2001 Le et al. ..... 331/17
7,119,527 B2 * 10/2006 Fernald ..... 323/315
7,122,997 B1 * 10/2006 Werking ..... 323/313
7,242,339 B1 7/2007 Truong et al.
7,304,532 B2 12/2007 Kim et al.
7,486,129 B2 * 2/2009 Pietri et al. ..... 327/539
7,733,179 B2 * 6/2010 Forejt ..... 330/258

OTHER PUBLICATIONS

Wang et al., A CMOS Voltage Reference Without Resistors for Ultra-low Power Applications, 7th International Conference on ASIC, Oct. 22-25, 2005, pp. 526-529, IEEE 2007.

* cited by examiner

*Primary Examiner* — Adolf Berhane
*Assistant Examiner* — Yemane Mehari
(74) *Attorney, Agent, or Firm* — Yudell Isidore Ng Russell PLLC

(57) ABSTRACT

A programmable voltage reference includes a temperature compensated current source and a voltage reference circuit. The temperature compensated current source includes an output configured to provide a reference current. The voltage reference circuit includes an input coupled to the output of the temperature compensated current source and a reference output. The voltage reference circuit includes a self-cascode metal-oxide semiconductor field-effect transistor structure that includes a first device that is diode-connected and operates in a weak inversion saturation region and a second device that operates in a weak inversion triode region. A length of the second device is selectable. The voltage reference circuit is configured to provide a reference voltage on the reference output based on the reference current.

20 Claims, 3 Drawing Sheets

PROGRAMMABLE VOLTAGE REFERENCE WITH A VOLTAGE REFERENCE CIRCUIT HAVING A SELF-CASCODE METAL-OXIDE SEMICONDUCTOR FIELD-EFFECT TRANSISTOR STRUCTURE

BACKGROUND OF THE INVENTION

1. Field of the Invention

The present disclosure relates generally to a voltage reference and, more particularly, to a programmable voltage reference.

2. Description of the Related Art

Today, systems, such as battery-powered systems, are usually designed to enter a low-power mode when the systems are not being utilized. When in the low-power mode it is desirable for the systems to consume a relatively small amount of power. In systems that utilize voltage references, it is desirable for the voltage references to be designed to consume a relatively small amount of power during normal operation, as well as when the systems are in a low-power mode. Voltage references are used in a variety of different applications. For example, analog-to-digital converters (ADCs), digital-to-analog converters (DACs), oscillators, flash memories, and voltage regulators usually require a voltage reference that is relatively insensitive to temperature, power supply, and load variations. The resolution of an ADC or a DAC, for example, is generally limited by the precision of an associated reference voltage over a power supply voltage range and operating temperature range.

Traditionally, bandgap voltage references have employed bipolar junction transistors (BJTs) to generate a relatively temperature independent reference voltage. In general, bandgap voltage references exhibit a relatively high power supply rejection ratio (PSRR) and a relatively low temperature coefficient. To reduce power consumption of integrated circuits (ICs), many IC designers have migrated from bipolar to complementary metal-oxide semiconductor (CMOS) processes. While bipolar CMOS (BiCMOS) processes may be used in the design of a bandgap voltage reference, BiCMOS devices are relatively expensive, as compared to CMOS devices. Moreover, bandgap voltage references have usually employed ratiometric related resistors. In a bandgap voltage reference, in order to provide for relatively low current, one resistor of the bandgap voltage reference is typically many times the size of another resistor. It should be appreciated that larger area resistors increase an area of an associated IC which, in turn, increases the cost of the associated IC.

U.S. Patent Application Publication No. 2006/0001412 (hereinafter "the '412 application") discloses a voltage reference that is fabricated exclusively using CMOS processes. The voltage reference of the '412 application employs a current generator that provides a proportional-to-absolute-temperature (PTAT) current. A stack of serially coupled metal-oxide semiconductor field-effect transistors (MOSFETs) is coupled between the current generator and a common point, i.e., ground. The stack of MOSFETs have a transimpedance which has a temperature coefficient that is opposite in polarity to a temperature coefficient of an internal resistance of the current generator.

BRIEF DESCRIPTION OF THE DRAWINGS

This invention is described in a preferred embodiment in the following description with reference to the drawings, in which like numbers represent the same or similar elements, as follows.

Figure 1:
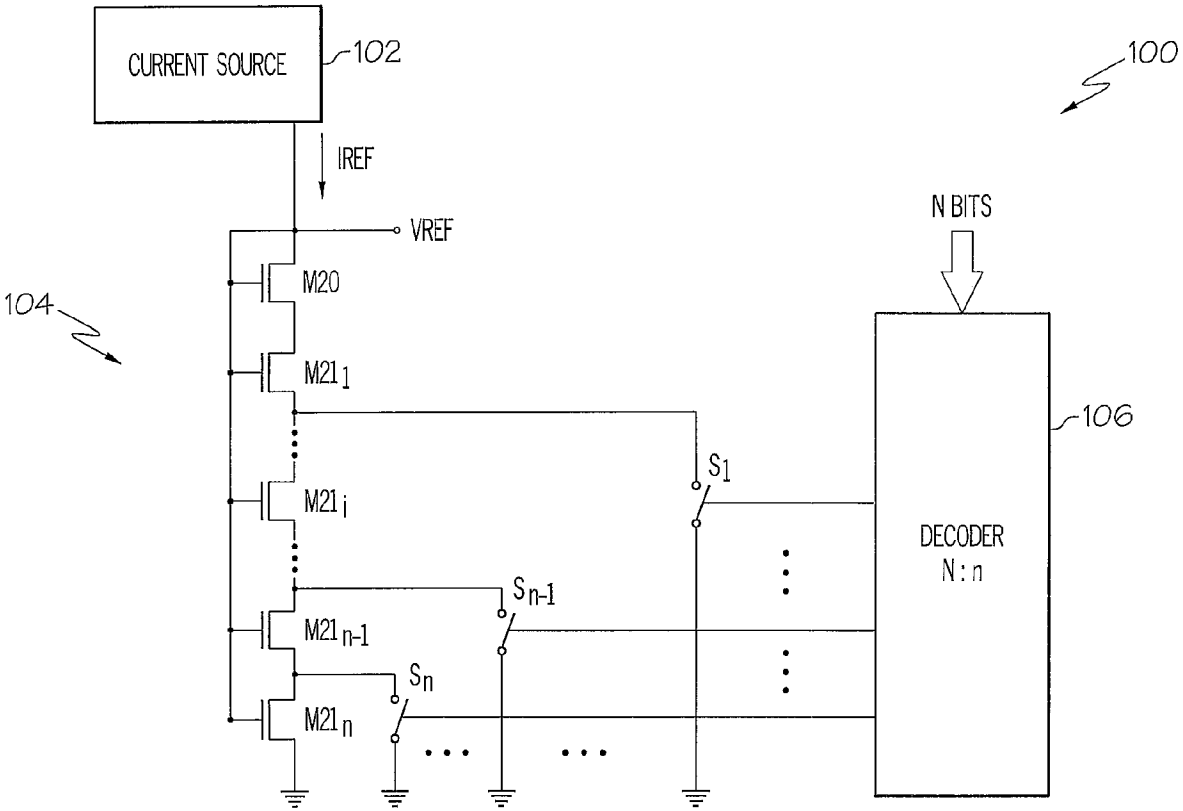
FIG. 1 is an electrical diagram of a programmable voltage reference, according to an embodiment of the present invention.

In the following detailed description of exemplary embodiments of the invention, reference is made to the accompanying drawings, which form a part hereof, and in which is shown by way of illustration specific exemplary embodiments in which the invention may be practiced.

DETAILED DESCRIPTION OF PREFERRED EMBODIMENTS

In the following detailed description of exemplary embodiments of the invention, specific exemplary embodiments in which the invention may be practiced are described in sufficient detail to enable those skilled in the art to practice the invention, and it is to be understood that other embodiments may be utilized and that logical, architectural, programmatic, mechanical, electrical and other changes may be made without departing from the spirit or scope of the present invention. The following detailed description is, therefore, not to be taken in a limiting sense, and the scope of the present invention is defined only by the appended claims. In particular, although the preferred embodiment is described below with respect to a battery-powered device, it will be appreciated that the present invention is not so limited and that it has application to other embodiments of electronic devices.

According to various aspects of the present disclosure, a voltage reference is disclosed that generates a reference voltage that is substantially constant over temperature, supply voltage, and process variations. Voltage references that provide a reference voltage that is substantially constant over temperature and process are highly desirable in a number of applications, e.g., battery-powered applications that employ microcontrollers. Moreover, such voltage references are highly desirable when employed with circuits that remain powered when a system power-down mode is entered.

According to various aspects of the present disclosure, a relatively low-cost area-effective complementary metal-oxide semiconductor (CMOS) compatible low-power programmable voltage reference (that is suitable for analog circuits) is described herein. The reference voltage, which may be programmed via digital trimming, may be configured to generate reference voltage levels less than one Volt with a behavior proportional-to-absolute-temperature (PTAT), zero-dependence-to-absolute-temperature (ZTAT), or complementary-to-absolute-temperature (CTAT). In one or more embodiments, a programmable voltage reference includes a reference voltage circuit and a temperature compensated current source that provides a reference current to the reference voltage circuit. In one or more embodiments, the reference voltage circuit includes a self-cascode metal-oxide semiconductor field-effect transistor (SCM) structure that includes an application appropriate number of n-channel metal-oxide semiconductor field-effect transistors (NMOS transistors). In one or more embodiments, each of the NMOS transistors have a same aspect ratio and are biased by a temperature compensated current source that provides a reference current (e.g., a PTAT current or a ZTAT current).

In various embodiments, the reference voltage provided by the reference voltage circuit corresponds to a gate voltage ($V_g$) of the SCM structure. To provide a relatively low-power reference voltage, a current provided by the current source may be limited to a few nanoamperes (e.g., 10-50 nA). In various embodiments, a voltage level provided by the reference voltage circuit may be varied by adding/removing NMOS transistors to/from the modified SCM structure. In general, the disclosed architecture supports transference from one fabrication facility to another while trimming facilitates low part-to-part variation.

In at least one embodiment, the temperature compensated current source is resistor-less and employs two modified SCM structures (i.e., a first SCM structure that operates in weak inversion and a second SCM structure that operates in moderate inversion) and a symmetrical low-voltage operational trans-resistance amplifier (OTRA) with a common source input pair. In at least one embodiment, the programmable voltage reference includes a third SCM structure (that includes NMOS transistors with a same aspect ratio) that is biased by a p-channel MOSFET (PMOS transistor) that functions as a current mirror in the current source and a digital decoder that facilitates switching NMOS transistors in to or out of the third SCM structure based on a digital input trimming code.

The reference voltage may be implemented in a number of different products, e.g., microcontroller units (MCUs), that are fabricated in various standard CMOS processes (e.g., 0.25 micron processes, 90 nanometer processes, 65 nanometer processes, etc.) and/or in various bipolar CMOS (BiCMOS) processes. The disclosed voltage reference may be used, for example, to provide a low-cost area-effective low-power programmable voltage reference for various analog integrated circuits (ICs), such as analog-to-digital converters (ADCs), digital-to-analog converters (DACs), comparators, oscillators, regulators, etc. While the discussion herein is directed to the use of n-channel and p-channel MOSFETs, it should be appreciated that in many applications other type of devices, e.g., bipolar junction transistors (BJTs), may be employed in various applications for at least some of the components. Moreover, in various applications, the channel type of the MOSFET employed may be changed. More generally, the MOSFET devices may be thought of as insulated gate FETs (IGFETS).

As used herein, 'weak inversion' can be thought of as an area of operation of a MOSFET where inversion charge Q1 (in a channel of the MOSFET) is an exponential function of gate voltage, 'strong inversion' can be thought of as an area where inversion charge Q1 (in the channel of the MOSFET) is a linear function of gate voltage, and moderate inversion can be thought of as a transition area between the weak and strong inversion areas. As one example, in terms of drain current density ($I_d$), the following approximations may be used for a MOSFET: $I_d$>10Is for strong inversion; $10I_s>I_d>0.1I_s$ for moderate inversion; and $I_d<0.1I_s$ for weak inversion, where $I_s$ is the moderate inversion characteristic current density as set forth in the Enz, Krummenacher, and Vittoz (EKV) model.

According to one embodiment of the present disclosure, a programmable voltage reference includes a temperature compensated current source and a voltage reference circuit. The temperature compensated current source includes an output configured to provide a reference current. The voltage reference circuit includes an input coupled to the output of the temperature compensated current source and a reference output. The voltage reference circuit includes a self-cascode metal-oxide semiconductor field-effect transistor structure that includes a first device that is diode-connected (e.g., a MOSFET with its gate connected to its drain) and operates in a weak inversion saturation region and a second device (e.g., a device that includes multiple serially coupled MOSFETs) that operates in a weak inversion triode region and is serially coupled to the first device. The length of the second device is selectable and the voltage reference circuit is configured to provide a reference voltage on the reference output based on the reference current.

With reference to FIG. 1, a programmable voltage reference 100 includes a voltage reference circuit (SCM structure) 104 (that includes NMOS transistors M20 and M21) that receives a reference current (IREF) from a current source 102 and switches $S_1$-$S_n$ that are used to select (in conjunction with decoder 106) a desired effective channel length (length) for the transistor M21. The temperature behavior of the programmable voltage reference 100 can be modified via digital trimming using the decoder 106 (which is configured to receive an 'N' bit control signal from a control unit (not shown) and control the switches $S_1$-$S_n$ to select the length of the transistor M21 to achieve a desired reference voltage (VREF) and desired temperature variation. In general, for a MOSFET operating in a triode region, temperature variation depends on a channel length of the transistor. According to various aspects of the present disclosure, the transistor M21 (which includes transistor $M21_1$-$M21_n$) is configured to operate in a weak inversion triode region and the transistor M20 is configured to operate in a weak inversion saturation region.

A length of the transistor M21, which is included within the SCM structure 104, is programmed to achieve a desired level for the reference voltage (VREF). Moreover, temperature slope programmability allows the SCM structure 104 to provide a wide range of temperature behaviors (e.g., PTAT, ZTAT, or CTAT) that are suitable for virtually any application that requires a reference voltage (e.g., regulators, oscillators, ADCs, DACs, temperature sensors, low voltage detectors (LVDs), etc.).

To create a universal programmable voltage reference (that is capable of providing a voltage that is PTAT, CTAT, or ZTAT), the threshold voltage of transistor M20 may be compensated over temperature. Temperature compensation may be achieved by generating a body effect voltage that affects the transistor M20. As is known, body effect appears when source and bulk terminals of a MOSFET are biased with different voltage levels. In the SCM structure 104, the body effect voltage (e.g., a PTAT voltage), which affects the transistor M20, is generated through the transistor M21. In general, granularity of trimming can be adjusted to offer a specific variation with temperature in any given application. Various embodiments of the reference voltage are fully compatible with standard CMOS technologies and provide relatively straight-forward implementations that exhibit a low risk design approach (with reduced area) and relatively low power consumption that makes the reference voltage attractive for low-cost low-power products.

Figure 2:
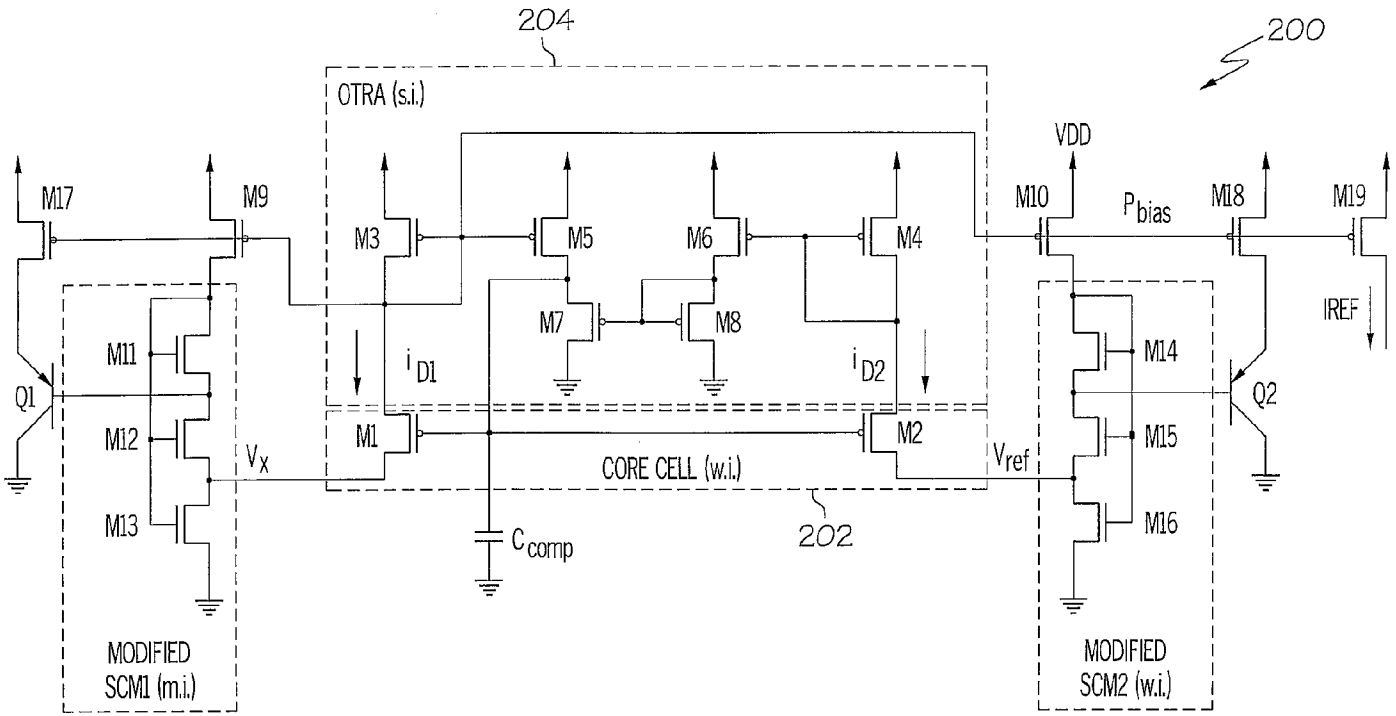
FIG. 2 is an electrical diagram of a temperature compensated current source that may be employed in the programmable voltage reference of FIG. 1.

With reference to FIG. 2, an example temperature compensated current source 200 includes a current source core cell 202 that includes NMOS transistors M1 and M2, which operate in a weak inversion saturation region. Source voltages for the transistors M1 and M2 are respectively provided by a modified first SCM structure SCM1 (which includes NMOS transistors M11, M12, and M13) and a modified second SCM structure SCM2 (which includes NMOS transistors M14, M15, and M16). The SCM structure SCM1 receives a feedback signal via pnp bipolar junction transistor (BJT) Q1 and p-channel MOSFET M17 and the SCM structure SCM2 receives a feedback signal via pnp BJT Q2 and p-channel MOSFET M18. An OTRA (which includes PMOS transistors M3, M4, M5, and M6 and NMOS transistors M7 and M8) 204, which is located in a feedback path between the first and second SCM structures SCM1 and SCM2, is configured to equalize current of the core cell 202 and ensure start-up of the current source 200. A current mirror M19 provides the reference current (IREF) to the third SCM structure 104, which functions as a voltage reference circuit.

The transistor M11 (of the first SCM structure SCM1) operates in a moderate inversion saturation region and the transistors M12 and M13 (of the first SCM structure SCM1) operate in a moderate inversion saturation region. The transistor M14 (of the second SCM structure SCM2) operates in weak inversion saturation region and the transistors M15 and M16 (of the second SCM structure SCM2) operate in a weak inversion triode region. In at least one embodiment, the reference current (IREF) provided by the current source 200 is substantially ZTAT and has a relatively small variation with process and power supply voltage (VDD) variations. For example, IREF may be equal to about 45 nanoamperes at 25 degrees C. with a minimum VDD of about 1.1V. Depending on the application, filtering of VREF may be desirable. In general, the programmable voltage reference disclosed herein may be designed to operate from about −40 degrees C. to about 150 degrees C. while consuming an operating current of less than about 100 nanoamperes.

Figure 3:
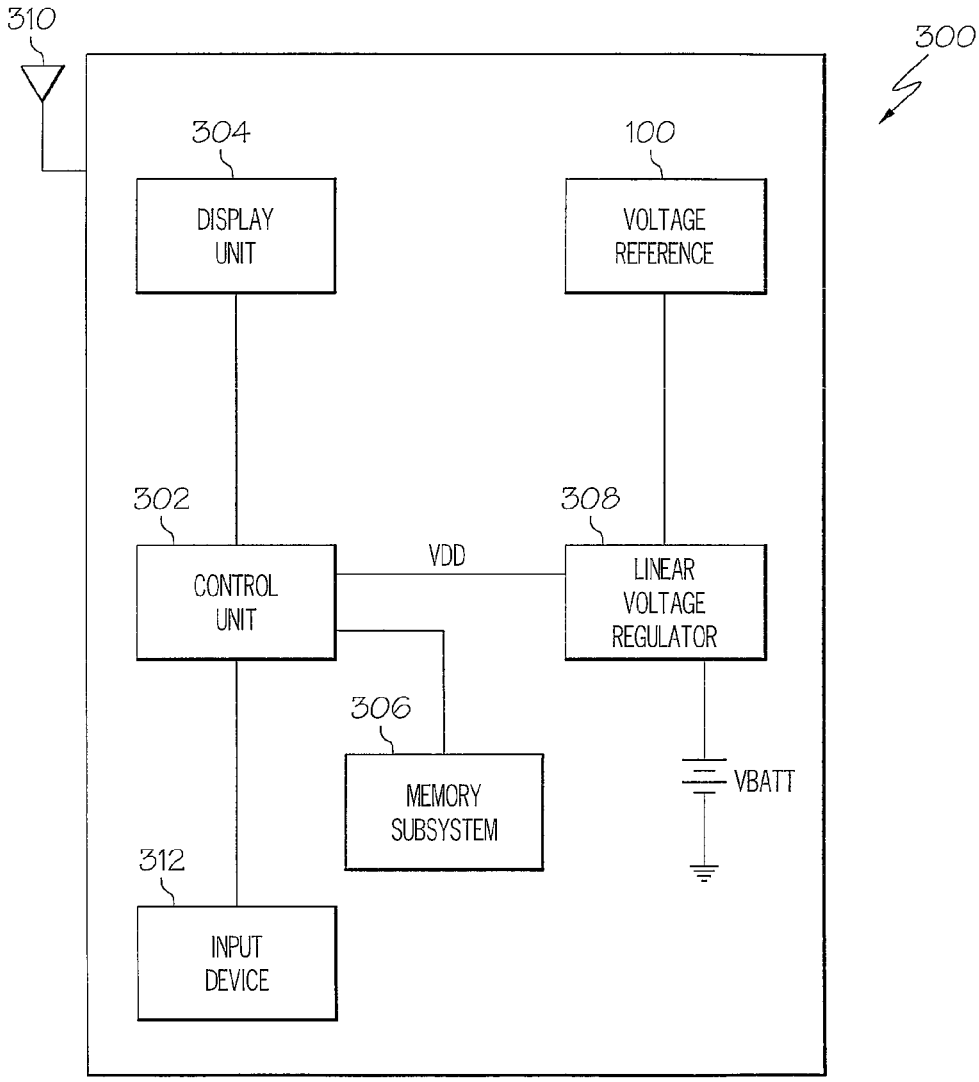
FIG. 3 is an electrical block diagram of an electronic device that employs one or more of the programmable voltage references of FIG. 1.

With reference to FIG. 3, an example electronic device 300 is illustrated that employs the programmable voltage reference 100 of FIG. 1 to provide a reference voltage to one or more components of the device 300. As is shown, the voltage reference 100 provides a reference voltage to a linear voltage regulator 308, which receives an input voltage provided by a battery (VBATT) and provides an output voltage (VDD) that powers a control unit (load) 302, which may be a microprocessor, microcontroller, etc. When the control unit 302 is programmable, various application and operating software may be stored within memory subsystem 306. The voltage reference 100 may also be employed within systems that are not battery-powered, e.g., systems that derive power from an alternating current (AC) power source.

It should be appreciated that multiple of the voltage references 100 may be employed within the device 300 to provide reference voltages at different voltage levels to different devices (voltage controlled oscillators (VCOs), current references, ADCs, DACs, etc.) of the device 300. As is shown, the control unit 302 is coupled to a display unit 304, e.g., a liquid crystal display (LCD), the memory subsystem 306, and an input device 312, e.g., a keypad and/or a mouse. The device 300 may include an antenna 310 and a transceiver (not shown) when the device 300 takes the form of a mobile wireless communication device.

Although the invention is described herein with reference to specific embodiments, various modifications and changes can be made without departing from the scope of the present invention as set forth in the claims below. For example, the programmable voltage references disclosed herein are broadly applicable to a variety of devices. Accordingly, the specification and figures are to be regarded in an illustrative rather than a restrictive sense, and all such modifications are intended to be included with the scope of the present invention. Any benefits, advantages, or solution to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A programmable voltage reference, comprising:

a temperature compensated current source including an output configured to provide a reference current; and a voltage reference circuit including an input coupled to the output of the temperature compensated current source and a reference output, wherein the voltage reference circuit includes a self-cascode metal-oxide semiconductor field-effect transistor structure that includes a first device that is diode-connected and operates in a weak inversion saturation region and a second device that operates in a weak inversion triode region and whose length is selectable, and wherein the voltage reference circuit is configured to provide a reference voltage at the reference output based on the reference current.

2. The programmable voltage reference of claim 1, wherein the second device includes multiple individually selectable n-channel metal-oxide semiconductor field-effect transistors.

3. The programmable voltage reference of claim 1, wherein the reference current is proportional-to-absolute-temperature.

4. The programmable voltage reference of claim 1, wherein the reference current has zero-dependence-to-absolute-temperature.

5. The programmable voltage reference of claim 1, further comprising:

a digital decoder having respective outputs coupled to respective inputs of the second device, wherein the digital decoder is configured to switch n-channel metal-oxide semiconductor field-effect transistors in to or out of the second device based on a digital input trimming code to achieve a desired length for the second device.

6. The programmable voltage reference of claim 1, wherein the reference voltage is less than about one Volt.

7. The programmable voltage reference of claim 1, wherein the reference current is less than about fifty nanoamperes and the temperature compensated current source includes a core cell that operates in a weak inversion saturation region.

8. The programmable voltage reference of claim 1, wherein an operating current of the programmable voltage reference is less than about one-hundred nanoamperes.

9. A method for providing a programmable voltage reference, comprising:

providing a reference current from an output of a temperature compensated current source;

receiving, at an input of a voltage reference circuit, the reference current; and providing, at a reference output of the voltage reference circuit, a reference voltage that is based on the reference current, wherein the voltage reference circuit includes a self-cascode metal-oxide semiconductor field-effect transistor structure that includes a first device that is diode-connected and operates in a weak inversion saturation region and a second device that operates in a weak inversion triode region and whose length is selectable.

10. The method of claim 9, wherein the second device includes multiple individually selectable n-channel metal-oxide semiconductor field-effect transistors.

11. The method of claim 9, wherein the reference current is proportional-to-absolute-temperature.

12. The method of claim 9, wherein the reference current has zero-dependence-to-absolute-temperature.

13. The method of claim 9, further comprising:

switching metal-oxide semiconductor field-effect transistors of the second device based on a digital input trimming code to achieve a desired length for the second device.

14. The method of claim 9, wherein the reference voltage is less than about one Volt.

15. The method of claim 9, wherein the reference current is less than about fifty nanoamperes.

16. The method of claim 9, wherein an operating current of the programmable voltage reference is less than about one-hundred nanoamperes.

17. A programmable voltage reference, comprising:

a temperature compensated current source including an output configured to provide a reference current;

a voltage reference circuit including an input coupled to the output of the temperature compensated current source and a reference output, wherein the voltage reference circuit includes a self-cascode metal-oxide semiconductor field-effect transistor structure that includes a first device that is diode-connected and operates in a weak inversion saturation region and a second device that operates in a weak inversion triode region and whose length is selectable, and wherein the voltage reference circuit is configured to provide a reference voltage at the reference output based on the reference current; and a digital decoder having respective outputs coupled to respective inputs of the second device, wherein the digital decoder is configured to switch metal-oxide semiconductor field-effect transistors of the second device based on a digital input trimming code to achieve a desired length for the second device.

18. The programmable voltage reference of claim 17, wherein the reference current is proportional-to-absolute-temperature.

19. The programmable voltage reference of claim 17, wherein the reference current has zero-dependence-to-absolute-temperature.

20. The programmable voltage reference of claim 17, wherein the reference voltage is less than about one Volt, the reference current is less than about fifty nanoamperes, and an operating current of the programmable voltage reference is less than about one-hundred nanoamperes.

* * * * *